US005972873A

United States Patent [19]

Nielsen et al.

[11] Patent Number: 5,972,873

[45] Date of Patent: Oct. 26, 1999

[54] 4-SUBSTITUTED-PHENYL-BORONIC ACIDS AS ENZYME STABILIZERS

[75] Inventors: Lone Kierstein Nielsen, Bagsvaerd, Denmark; Allison Deane-Wray, Hampshire, United Kingdom

[73] Assignee: Novo Nordisk A/S, Bagsvaerd, Denmark

[21] Appl. No.: 08/975,870

[22] Filed: Nov. 21, 1997

Related U.S. Application Data

[63] Continuation of application No. PCT/DK96/00252, Jun. 10, 1996.

[30] Foreign Application Priority Data

Jun. 13, 1995 [DK] Denmark ..... 0674/95
Sep. 7, 1995 [DK] Denmark ..... 0983/95

[51] Int. Cl.[6] ..... C11D 3/386; C11D 3/04

[52] U.S. Cl. ..... 510/392; 510/530; 510/393; 510/321; 510/320; 510/465

[58] Field of Search ..... 510/530, 392, 510/393, 321, 465, 320

[56] References Cited

U.S. PATENT DOCUMENTS

| | | | |
|---|---|---|---|
| 5,039,446 | 8/1991 | Estell | 252/174.2 |
| 5,354,491 | 10/1994 | Bjorkquist et al. | 252/135 |
| 5,431,842 | 7/1995 | Panandiker et al. | 252/135 |
| 5,472,628 | 12/1995 | Panandiker et al. | 252/135 |
| 5,488,157 | 1/1996 | Bjorkquist et al. | 562/7 |
| 5,580,486 | 12/1996 | Labeque et al. | 510/321 |
| 5,582,762 | 12/1996 | Labeque et al. | 510/321 |
| 5,691,292 | 11/1997 | Marshall et al. | 510/221 |

FOREIGN PATENT DOCUMENTS

| | | |
|---|---|---|
| 0 478 050 | 4/1992 | European Pat. Off. . |
| WO 92/19707 | 11/1992 | WIPO . |
| WO 95/12655 | 5/1995 | WIPO . |

OTHER PUBLICATIONS

Beesley et al "The inhibitons of class C Bβlactamases by boronic acid", Biochem J. vol. 209, pp. 221–233, 1983.

Philipp et al., Molecular and Cellular Biochemistry, 51, pp. 5–32, (1983).

Beesley, Biochem. J., vol. 209, No. 1, pp. 229–233 (1983).

Keller et al., Biochemical And Biophysical Research Communications, pp. 401–405 (Apr. 15, 1991).

*Primary Examiner*—Kery Fries
*Attorney, Agent, or Firm*—Steve T. Zelson; Carol E. Rozek

[57] ABSTRACT

The present invention relates to a liquid composition comprising an enzyme and a phenyl boronic acid derivative enzyme stabilizer of the following formula:

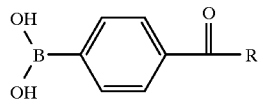

wherein R is selected from the group consisting of hydrogen, hydroxy, $C_1$–$C_6$ alkyl, substituted $C_1$–$C_6$ alkyl, $C_1$–$C_6$ alkenyl and substituted $C_1$–$C_6$ alkenyl.

20 Claims, No Drawings

4-SUBSTITUTED-PHENYL-BORONIC ACIDS AS ENZYME STABILIZERS

CROSS-REFERENCE TO RELATED APPLICATIONS

This application is a continuation of application serial no. PCT/DK96/00252 filed Jun. 10, 1996 and claims priority under 35 U.S.C. 119 of Danish application serial no. 0674/95 and 0983/95 filed Jun. 13, 1995 and Sep. 7, 1995, respectively, the contents of which are fully incorporated herein by reference.

FIELD OF INVENTION

This invention relates to a liquid composition, in particular to a liquid detergent composition, comprising an enzyme and an improved enzyme stabilizer.

BACKGROUND OF THE INVENTION

Storage stability problems are well known with liquids containing enzyme(s). Especially in enzyme-containing liquid detergents a major problem, in particular if the detergent contains protease, is that of ensuring enzyme activity over time.

The prior art has dealt extensively with improving the storage stability, for example by adding a protease inhibitor.

Boric acid and boronic acids are known to reversibly inhibit proteolytic enzymes. A discussion of the inhibition of one serine protease, subtilisin, by boronic acid is provided in *Molecular & Cellular Biochemistry* 51, 1983, pp. 5–32.

Boronic acids have very different capacities as subtilisin inhibitors. Boronic acids containing only alkyl groups such as methyl, butyl or 2-cyclohexylethyl are poor inhibitors with methylboronic acid as the poorest inhibitor, whereas boronic acids bearing aromatic groups such as phenyl, 4-methoxyphenyl or 3,5-dichlorophenyl are good inhibitors with 3,5-dichlorophenylboronic acid as a particularly effective one (see Keller et al, *Biochem. Biophys. Res. Com.* 176, 1991, pp. 401–405).

It is also claimed that aryl boronic acids which have a substitution at the 3-position relative to boron are unexpectedly good reversible protease inhibitors. Especially, acetamidophenyl boronic acid is claimed to be a superior inhibitor of proteolytic enzymes (see WO 92/19707).

The inhibition constant ($K_i$) is ordinarily used as a measure of capacity to inhibit enzyme activity, with a low $K_i$ indicating a more potent inhibitor. However, it has earlier been found that the $K_i$ values of boronic acids do not always tell how effective inhibitors are (see for instance WO 92/19707).

SUMMARY OF THE INVENTION

In this invention it is surprisingly found that phenyl boronic acid derivatives substituted in the para-position with a >C=O adjacent to the phenyl boronic acid have extraordinary good capacities as enzyme stabilizers in liquids.

Accordingly, the present invention relates to a liquid composition comprising an enzyme and a phenyl boronic acid derivative enzyme stabilizer of the following formula:

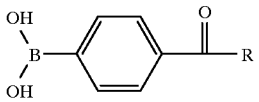

wherein R is selected from the group consisting of hydrogen, hydroxy, $C_1$–$C_6$ alkyl, substituted $C_1$–$C_6$ alkyl, $C_1$–$C_6$ alkenyl and substituted $C_1$–$C_6$ alkenyl.

DETAILED DISCLOSURE OF THE INVENTION

One embodiment of the present invention provides a liquid composition comprising an enzyme and a phenyl boronic acid derivative enzyme stabilizer of the following formula:

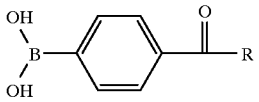

wherein R is selected from the group consisting of hydrogen, hydroxy, $C_1$–$C_6$ alkyl, substituted $C_1$–$C_6$ alkyl, $C_1$–$C_6$ alkenyl and substituted $C_1$–$C_6$ alkenyl.

A preferred embodiment of the present invention provides a liquid composition comprising an enzyme and a phenyl boronic acid derivative enzyme stabilizer of the formula disclosed above, wherein R is a $C_1$–$C_6$ alkyl, in particular wherein R is $CH_3$, $CH_3CH_2$ or $CH_3CH_2CH_2$, or wherein R is hydrogen.

A further preferred embodiment of the present invention provides a liquid detergent composition comprising a surfactant, an enzyme and a phenyl boronic acid derivative enzyme stabilizer of the formula disclosed above.

Preparation of Phenyl Boronic Acid Derivatives

Phenyl boronic acid derivatives may be prepared using methods well known to those skilled in the art, for example by using a Grignard preparation:

The Grignard reagent is prepared by the slow dropwise addition of the appropriate bromobenzene starting material in anhydrous ether to magnesium turnings in anhydrous ether. The anhydrous ether may be, e.g., sodium dried diethylether or sodium dried tetrahydrofuran. The reaction is encouraged by the addition of a small iodine crystal.

Trimethylborate or tri-n-butylborate in anhydrous ether (e.g. sodium dried diethylether or sodium dried tetrahydrofuran) is cooled to about −70° C. and the Grignard reagent is added dropwise over a period of approximately 2 hours while keeping the borate solution at about −70° C. and continuously agitating.

The reaction mixture is allowed to warm to room temperature overnight whereupon it is hydrolysed by the dropwise addition of cold dilute sulphuric acid. The ether layer is separated and the aqueous layer extracted with ether. The ether containing fractions are combined and the solvent removed. The residue is made distinctly alkaline and any methanol or butanol so formed is removed. The alkaline solution is made acidic and cooled and the resulting crystals of desired boronic acid are removed by filtration. All products are preferably recrystallized from distilled water or some other appropriate solvent.

Preparation of, e.g., 4-formyl-phenyl-boronic acid, using the method disclosed above, has been described in *Chem. Ber.* 123, 1990, pp. 1841–1843.

The phenyl boronic acids may also be prepared using either direct lithiation of the benzene and/or lithiation of the bromide.

Any nuclear substitution or protection of functional groups may be achieved by using standard methods well known to those skilled in the art.

Stabilizers

According to the invention the liquid composition may contain up to 500 mM of the stabilizer (the phenyl boronic acid derivative), preferably the detergent composition may contain 0.001–250 mM of the stabilizer, more preferably the liquid composition may contain 0.005–100 mM of the stabilizer, most preferably the liquid composition may contain 0.01–10 mM of the stabilizer. The phenyl boronic acid derivative may be an acid or the alkali metal salt of said acid.

Enzymes

According to the invention the liquid composition contains at least one enzyme. The enzyme may be any commercially available enzyme, in particular an enzyme selected from the group consisting of proteases, amylases, lipases, cellulases, oxidoreductases and any mixture thereof. Mixtures of enzymes from the same class (e.g. proteases) are also included.

According to the invention a liquid composition comprising a protease is preferred; more preferred is a liquid composition comprising two or more enzymes in which the first enzyme is a protease and the second enzyme is selected from the group consisting of amylases, lipases, cellulases and oxidoreductases; even more preferred is a liquid composition in which the first enzyme is a protease and the second enzyme is a lipase.

The amount of enzyme used in the liquid composition varies according to the type of enzyme(s). The amount of each enzyme will typically be 0.04–40 $\mu$M, in particular 0.2–30 $\mu$M, especially 0.4–20 $\mu$M (generally 1–1000 mg/l, in particular 5–750 mg/l, especially 10–500 mg/l) calculated as pure enzyme protein.

Proteases: Suitable proteases include those of animal, vegetable or microbial origin. Microbial origin is preferred. Chemically or genetically modified mutants are included. The protease may be a serine protease, preferably an alkaline microbial protease or a trypsin-like protease. Examples of alkaline proteases are subtilisins, especially those derived from Bacillus, e.g., subtilisin Novo, subtilisin Carlsberg, subtilisin 309, subtilisin 147 and subtilisin 168 (described in WO 89/06279). Examples of trypsin-like proteases are trypsin (e.g. of porcine or bovine origin) and the Fusarium protease described in WO 89/06270.

Preferred commercially available protease enzymes include those sold under the tradenames Alcalase, Savinase, Primase, Durazym, and Esperase by Novo Nordisk A/S (Denmark), those sold under the tradename Maxatase, Maxacal, Maxapem and Properase by Gist-Brocades, those sold under the tradename Purafect and Purafect OXP by Genencor International, and those sold under the tradename Opticlean and Optimase by Solvay Enzymes.

Lipases: Suitable lipases include those of bacterial or fungal origin. Chemically or genetically modified mutants are included.

Examples of useful lipases include a *Humicola lanuginosa* lipase, e.g., as described in EP 258 068 and EP 305 216, a *Rhizomucor miehei* lipase, e.g., as described in EP 238 023, a Candida lipase, such as a *C. antarctica* lipase, e.g., the *C. antarctica* lipase A or B described in EP 214 761, a Pseudomonas lipase such as a *P. pseudoalcaligenes* and *P. alcaligenes* lipase, e.g., as described in EP 218 272, a *P. cepacia* lipase, e.g., as described in EP 331 376, a *P. stutzeri* lipase, e.g., as disclosed in BP 1,372,034, a *P. fluorescens* lipase, a Bacillus lipase, e.g., a *B. subtilis* lipase (Dartois et al., (1993), *Biochemica et Biophysica acta* 1131, 253–260), a *B. stearothermophilus* lipase (JP 64/744992) and a *B. pumilus* lipase (WO 91/16422).

Furthermore, a number of cloned lipases may be useful, including the *Penicillium camenbertii* lipase described by Yamaguchi et al., (1991), *Gene* 103, 61–67), the *Geotricum candidum* lipase (Schimada, Y. et al., (1989), *J. Biochem.* 106, 383–388), and various Rhizopus lipases such as a *R. delemar* lipase (Hass, M. J et al., (1991), *Gene* 109, 117–113), a *R. niveus* lipase (Kugimiya et al., (1992), *Biosci. Biotech. Biochem.* 56, 716–719) and a *R. oryzae* lipase.

Other types of lipolytic enzymes such as cutinases may also be useful, e.g., a cutinase derived from *Pseudomonas mendocina* as described in WO 88/09367, or a cutinase derived from *Fusarium solani* pisi (e.g. described in WO 90/09446).

Especially suitable lipases are lipases such as M1 Lipase™, Luma fast™ and Lipomax™ (Genencor), Lipolase™ and Lipolase Ultra™ (Novo Nordisk A/S), and Lipase P "Amano" (Amano Pharmaceutical Co. Ltd.).

Amylases: Suitable amylases ($\alpha$ and/or $\beta$) include those of bacterial or fungal origin. Chemically or genetically modified mutants are included. Amylases include, for example, a-amylases obtained from a special strain of *B. licheniformis,* described in more detail in British Patent Specification No. 1,296,839. Commercially available amylases are Duramyl™, Termamyl™, Fungamyl™ and BAN™ (available from Novo Nordisk A/S) and Rapidase™ and Maxamyl P™ (available from Gist-Brocades).

Cellulases: Suitable cellulases include those of bacterial or fungal origin. Chemically or genetically modified mutants are included. Suitable cellulases are disclosed in U.S. Pat. No. 4,435,307, which discloses fungal cellulases produced from *Humicola insolens.* Especially suitable cellulases are the cellulases having color care benefits. Examples of such cellulases are cellulases described in European patent application No. 0 495 257.

Commercially available cellulases is Celluzyme™ produced by a strain of *Humicola insolens* (Novo Nordisk A/S), and KAC-500(B)™ (Kao Corporation).

Oxidoreductases: Any oxidoreductase suitable for use in a liquid composition, e.g., peroxidases or oxidases such as laccases, can be used herein. Suitable peroxidases herein include those of plant, bacterial or fungal origin. Chemically or genetically modified mutants are included. Examples of suitable peroxidases are those derived from a strain of Coprinus, e.g., *C. cinerius* or *C. macrorhizus,* or from a strain of Bacillus, e.g., *B. pumilus,* particularly peroxidase according to WO 91/05858. Suitable laccases herein include those of bacterial or fungal origin. Chemically or genetically modified mutants are included. Examples of suitable laccases are those obtainable from a strain of Trametes, e.g., *T. villosa* or *T. versicolor,* or from a strain of Coprinus, e.g., *C. cinereus,* or from a strain of Myceliophthora, e.g., *M. thermophila.*

Detergents

According to the invention the liquid detergent composition will beside enzyme(s) and stabilizer comprise a surfactant. The detergent composition may, e.g., be a laundry detergent composition or a dishwashing detergent composition.

The detergent may be aqueous, typically containing up to 70% water and 0–30% organic solvent, or nonaqueous.

The detergent composition comprises one or more surfactants, each of which may be anionic, nonionic, cationic, or amphoteric (zwitterionic). The detergent will usually contain 0–50% of anionic surfactant such as linear alkylbenzenesulfonate (LAS), alpha-olefinsulfonate (AOS), alkyl sulfate (fatty alcohol sulfate) (AS), alcohol ethoxysulfate (AEOS or AES), secondary alkanesulfonates (SAS), alpha-sulfo fatty acid methyl esters, alkyl- or alkenylsuccinic acid, or soap. It may also contain 0–40% of nonionic surfactant such as alcohol ethoxylate (AEO or AE), alcohol propoxylate, carboxylated alcohol ethoxylates, nonylphenol ethoxylate, alkylpolyglycoside, alkyldimethylamine oxide, ethoxylated fatty acid monoethanolamide, fatty acid monoethanolamide, or polyhydroxy alkyl fatty acid amide (e.g. as described in WO 92/06154).

Normally the detergent contains 1–65 % of a detergent builder, but some dishwashing detergents may contain even up to 90% of a detergent builder, or complexing agent such as zeolite, diphosphate, triphosphate, phosphonate, citrate, nitrilotriacetic acid (NTA), ethylenediaminetetraacetic acid (EDTA), diethylenetriaminepentaacetic acid (DTMPA), alkyl- or alkenylsuccinic acid, soluble silicates or layered silicates (e.g. SKS-6 from Hoechst).

The detergent builders may be subdivided into phosphorus-containing and non-phosphorous-containing types. Examples of phosphorus-containing inorganic alkaline detergent builders include the water-soluble salts, especially alkali metal pyrophosphates, orthophosphates, polyphosphates and phosphonates. Examples of non-phosphorus-containing inorganic builders include water-soluble alkali metal carbonates, borates and silicates as well as layered disilicates and the various types of water-insoluble crystalline or amorphous alumino silicates of which zeolites is the best known representative.

Examples of suitable organic builders include alkali metal, ammonium or substituted ammonium salts of succinates, malonates, fatty acid malonates, fatty acid sulphonates, carboxymethoxy succinates, polyacetates, carboxylates, polycarboxylates, aminopolycarboxylates and polyacetyl carboxylates.

The detergent may also be unbuilt, i.e. essentially free of detergent builder.

The detergent may comprise one or more polymers. Examples are carboxymethylcellulose (CMC), poly (vinylpyrrolidone) (PVP), polyethyleneglycol (PEG), poly (vinyl alcohol) (PVA), polycarboxylates such as polyacrylates, polymaleates, maleic/acrylic acid copolymers and lauryl methacrylate/acrylic acid copolymers.

The detergent composition may contain bleaching agents of the chlorine/bromine-type or the oxygen-type. The bleaching agents may be coated or encapsulated. Examples of inorganic chlorine/bromine-type bleaches are lithium, sodium or calcium hypochlorite or hypobromite as well as chlorinated trisodium phosphate. The bleaching system may also comprise a $H_2O_2$ source such as perborate or percarbonate which may be combined with a peracid-forming bleach activator such as tetraacetylethylenediamine (TAED) or nonanoyloxybenzenesulfonate (NOBS).

Examples of organic chlorine/bromine-type bleaches are heterocyclic N-bromo and N-chloro imides such as trichloroisocyanuric, tribromoisocyanuric, dibromoisocyanuric and dichloroisocyanuric acids, and salts thereof with water solubilizing cations such as potassium and sodium. Hydantoin compounds are also suitable. The bleaching system may also comprise peroxyacids of, e.g., the amide, imide, or sulfone type.

In dishwashing detergents the oxygen bleaches are preferred, for example in the form of an inorganic persalt, preferably with a bleach precursor or as a peroxy acid compound. Typical examples of suitable peroxy bleach compounds are alkali metal perborates, both tetrahydrates and monohydrates, alkali metal percarbonates, persilicates and perphosphates. Preferred activator materials are TAED or NOBS.

The enzyme(s) of the detergent composition of the invention may additionally be stabilized using conventional stabilizing agents, e.g., a polyol such as propylene glycol or glycerol, a sugar or sugar alcohol, or lactic acid.

The detergent may also contain other conventional detergent ingredients such as, e.g., fabric conditioners including clays, deflocculant material, foam boosters/foam depressors (in dishwashing detergents foam depressors), suds suppressors, anti-corrosion agents, soil-suspending agents, anti-soil-redeposition agents, dyes, dehydrating agents, bactericides, optical brighteners, or perfume.

The pH (measured in aqueous solution at use concentration) will usually be neutral or alkaline, e.g. in the range of 7–11.

Particular forms of laundry detergent compositions within the scope of the invention include:

1) An aqueous liquid detergent composition comprising

| | |
|---|---|
| Linear alkylbenzenesulfonate (calculated as acid) | 15–21% |
| Alcohol ethoxylate (e.g. $C_{12-15}$ alcohol, 7 EO or $C_{12-15}$ alcohol, 5 EO) | 12–18% |
| Soap as fatty acid (e.g. oleic acid) | 3–13% |
| Alkenylsuccinic acid ($C_{12-}$14) | 0–13% |
| Aminoethanol | 8–18% |
| Citric acid | 2–8% |
| Phosphonate | 0–3% |
| Polymers (e.g. PVP, PEG) | 0–3% |
| Borate (as $B_4O_7$) | 0–2% |
| Ethanol | 0–3% |
| Propylene glycol | 8–14% |
| Enzymes (calculated as pure enzyme protein) | 0.0001–0.1% |
| Minor ingredients (e.g. dispersants, suds suppressors, perfume, optical brightener) | 0–5% |

2) An aqueous structured liquid detergent composition comprising

| | |
|---|---|
| Linear alkylbenzenesulfonate (calculated as acid) | 15–21% |
| Alcohol ethoxylate (e.g. $C_{12-15}$ alcohol, 7 EO or $C_{12-15}$ alcohol, 5 EO) | 3–9% |
| Soap as fatty acid (e.g. oleic acid) | 3–10% |
| Zeolite (as $NaAlSiO_4$) | 14–22% |
| Potassium citrate | 9–18% |
| Borate (as $B_4O_7$) | 0–2% |
| Carboxymethylcellulose | 0–2% |
| Polymers (e.g. PEG, PVP) | 0–3% |
| Anchoring polymers such as, e.g., lauryl methacrylate/acrylic acid copolymer; molar ratio 25:1; MW 3800 | 0–3% |
| Glycerol | 0–5% |
| Enzymes (calculated as pure enzyme protein) | 0.0001–0.1% |
| Minor ingredients (e.g. dispersants, suds suppressors, perfume, optical brighteners) | 0–5% |

3) An aqueous liquid detergent composition comprising

| | |
|---|---|
| Linear alkylbenzenesulfonate (calculated as acid) | 15–23% |
| Alcohol ethoxysulfate (e.g. $C_{12-15}$ alcohol, 2–3 EO) | 8–15% |
| Alcohol ethoxylate (e.g. $C_{12-15}$ alcohol, 7 EO or $C_{12-15}$ alcohol, 5 EO) | 3–9% |
| Soap as fatty acid (e.g. lauric acid) | 0–3% |
| Aminoethanol | 1–5% |
| Sodium citrate | 5–10% |
| Hydroprope (e.g. sodium toluensulfonate) | 2–6% |
| Borate (as $B_4O_7$) | 0–2% |
| Carboxymethylcellulose | 0–1% |
| Ethanol | 1–3% |
| Propylene glycol | 2–5% |
| Enzymes (calculated as pure enzyme protein) | 0.0001–0.1% |
| Minor ingredients (e. g. polymers, dispersants, perfume, optical brighteners) | 0–5% |

4) An aqueous liquid detergent composition comprising

| | |
|---|---|
| Linear alkylbenzenesulfonate (calculated as acid) | 20–32% |
| Alcohol ethoxylate (e.g. $C_{12-15}$ alcohol, 7 EO or $C_{12-15}$ alcohol, 5 EO) | 6–12% |
| Aminoethanol | 2–6% |
| Citric acid | 8–14% |
| Borate (as $B_4O_7$) | 1–3% |
| Polymer (e.g. maleic/acrylic acid copolymer, anchoring polymer such as, e.g., lauryl methacrylate/acrylic acid copolymer) | 0–3% |
| Glycerol | 3–8% |
| Enzymes (calculated as pure enzyme protein) | 0.0001–0.1% |
| Minor ingredients (e.g. hydrotropes, dispersants, perfume, optical brighteners) | 0–5% |

5) Detergent formulations as described in 1)–4) wherein all or part of the linear alkylbenzenesulfonate is replaced by ($C_{12}$–$C_{18}$) alkyl sulfate.

6) Detergent formulations as described in 1)–5) which contain a stabilized or encapsulated peracid, either as an additional component or as a substitute for already specified bleach systems.

7) Detergent composition formulated as a nonaqueous detergent liquid comprising a liquid nonionic surfactant such as, e.g., linear alkoxylated primary alcohol, a builder system (e.g. phosphate), enzyme and alkali. The detergent may also comprise anionic surfactant and/or a bleach system.

Particular forms of dishwashing detergent compositions within the scope of the invention include:

1) Liquid Dishwashing Composition with Cleaning Surfactant System

| | |
|---|---|
| Nonionic surfactant | 0–1.5% |
| Octadecyl diniethylamine N-oxide dihydrate | 0–5% |
| 80:20 wt. C18/C16 blend of octadecyl dimethylamine N-oxide dihydrate and hexadecyldimethyl amine N-oxide dihydrate | 0–4% |
| 70:30 wt. C18/C16 blend of octadecyl bis (hydroxyethyl)amine N-oxide anhydrous and hexadecyl bis (hydroxyethyl)amine N-oxide anhydrous | 0–5% |
| $C_{13}$–$C_{15}$ alkyl ethoxysulfate with an average degree of ethoxylation of 3 | 0–10% |
| $C_{12}$–$C_{15}$ alkyl ethoxysulfate with an average degree of ethoxylation of 3 | 0–5% |
| $C_{13}$–$C_{15}$ ethoxylated alcohol with an average degree of ethoxylation of 12 | 0–5% |
| A blend of $C_{12}$–$C_{15}$ ethoxylated alcohols with an average degree of ethoxylation of 9 | 0–6.5% |
| A blend of $C_{13}$–$C_{15}$ ethoxylated alcohols with an average degree of ethoxylation of 30 | 0–4% |
| Sodium disilicate | 0–33% |
| Sodium tripolyphosphate | 0–46% |
| Sodium citrate | 0–28% |
| Citric acid | 0–29% |
| Sodium carbonate | 0–20% |
| Sodium perborate monohydrate | 0–11.5% |
| Tetraacetylethylenediamine (TAED) | 0–4% |
| Maleic acid/acrylic acid copolymer | 0–7.5% |
| Sodium sulphate | 0–12.5% |
| Enzymes | 0.0001–0.1% |

2) Non-aqueous Liquid Automatic Dishwashing Composition

| | |
|---|---|
| Liquid nonionic surfactant (e.g. alcohol ethoxylates) | 2.0–10.0% |
| Alkali metal silicate | 3.0–15.0% |
| Alkali metal phosphate | 20.0–40.0% |
| Liquid carrier selected from higher glycols, polyglycols, polyoxides, glycolethers | 25.0–45.0% |
| Stabilizer (e.g. a partial ester of phosphoric acid and a $C_{16}$–$C_{18}$ alkanol) | 0.5–7.0% |
| Foam suppressor (e.g. silicone) | 0–1.5% |
| Enzymes | 0.0001–0.1% |

3) Non-Aqueous Liquid Dishwashing Composition

| | |
|---|---|
| Liquid nonionic surfactant (e.g alcohol ethoxylates) | 2.0–10.0% |
| Sodium silicate | 3.0–15.0% |
| Alkali metal carbonate | 7.0–20.0% |
| Sodium citrate | 0.0–1.5% |
| Stabilizing system (e.g. mixtures of finely divided silicone and low molecular weight dialkyl polyglycol ethers) | 0.5–7.0% |
| Low molecule weight polyacrylate polymer | 5.0–15.0% |
| Clay gel thickener (e. g. bentonite) | 0.0–10.0% |
| Hydroxypropyl cellulose polymer | 0.0–0.6% |
| Enzymes | 0.0001–0.1% |
| Liquid carrier selected from higher lycols, polyglycols, polyoxides and glycol ethers | Balance |

4) Thixotropic Liquid Automatic Dishwashing Composition

| | |
|---|---|
| $C_{12}$–$C_{14}$ fatty acid | 0–0.5% |
| Block co-polymer surfactant | 1.5–15.0% |
| Sodium citrate | 0–12% |
| Sodium tripolyphosphate | 0–15% |
| Sodium carbonate | 0–8% |
| Aluminium tristearate | 0–0.1% |
| Sodium cumene sulphonate | 0–1.7% |
| Polyacrylate thickener | 1.32–2.5% |
| Sodium polyacrylate | 2.4–6.0% |
| Boric acid | 0–4.0% |
| Sodium formate | 0–0.45% |
| Calcium formate | 0–0.2% |
| Sodium n-decydiphenyl oxide disulphonate | 0–4.0% |
| Monoethanol amine (MBA) | 0–1.86% |
| Sodium hydroxide (50%) | 1.9–9.3% |
| 1,2-Propanediol | 0–9.4% |
| Enzymes | 0.0001–0.1% |
| Suds suppressor, dye, perfumes, water | Balance |

5) Liquid Automatic Dishwashing Composition

| | |
|---|---|
| Alcohol ethoxylate | 0–20% |
| Fatty acid ester sulphonate | 0–30% |
| Sodium dodecyl sulphate | 0–20% |
| Alkyl polyglycoside | 0–21% |
| Oleic acid | 0–10% |
| Sodium disilicate monohydrate | 18–33% |
| Sodium citrate dihydrate | 18–33% |
| Sodium stearate | 0–2.5% |
| Sodium perborate monohydrate | 0–13% |
| Tetraacetylethylenediamine (TAED) | 0–8% |
| Maleic acid/acrylic acid copolymer | 4–8% |
| Enzymes | 0.0001–0.1% |

6) Liquid Automatic Dishwashing Composition Containing Protected Bleach Particles

| | |
|---|---|
| Sodium silicate | 5–10% |
| Tetrapotassium pyrophosphate | 15–25% |
| Sodium triphosphate | 0–2% |
| Potassium carbonate | 4–8% |
| Protected bleach particles, e.g. chlorine | 5–10% |
| Polymeric thickener | 0.7–1.5% |
| Potassium hydroxide | 0–2% |
| Enzymes | 0.0001–0.1% |
| Water | Balance |

7) Automatic dishwashing compositions as described in 1) and 5), wherein perborate is replaced by percarbonate.

8) Automatic dishwashing compositions as described in 1), which additionally contain a manganese catalyst. The manganese catalyst may, e.g., be one of the compounds described in "Efficient manganese catalysts for low-temperature bleaching", Nature 369, 1994, pp. 637–639.

Tests of Stabilizers

According to the invention the effectiveness of each stabilizer may be tested in one or more of the following tests:

a) Storage Stability Test in Liquid Detergent: Enzyme(s) and stabilizer are added to a liquid detergent formulation and stored at well defined conditions. The enzyme activity of each enzyme is determined as a function of time, e.g. after 0, 3, 7 and 14 days.

To calculate the inhibition efficiency from the storage stability date a reaction mechanism is proposed. The following reactions give a relatively simple, but yet plausible, mechanism for a liquid detergent containing protease (P), lipase (L), and inhibitor (I):

I) Autodigestion of protease:

$$P+P \rightarrow D_P+P$$

II) Denaturation of protease:

$$P \rightarrow D_P$$

III) Inhibition of protease:

$$P+I \leftrightarrows PI$$

IV) Protease digestion of inhibited enzyme:

$$P+PI \rightarrow P+D_P+I$$

V) Denaturation of inhibited enzyme:

$$PI \rightarrow D_P+I$$

VI) Protease digestion of lipase:

$$P+L \rightarrow P+D_L$$

VII) Denaturation of lipase:

$$L \rightarrow D_L$$

where $D_P$ and $D_L$ are denatured (i.e. non-active) protease and lipase.

From these reactions three coupled differential equations are derived describing the deactivation of P, L and PI. The reaction rate constants are derived from storage stability data by the use of a parameter estimation method (Gauss-Newton with the Levenberg modification). The storage stability data give the concentration of (P+PI) and L as a function of time.

Reaction III is much faster than the other reactions and equilibrium is assumed in the calculations. Reaction IV is excluded from the system to reduce the number of parameters thereby describing the stability of the inhibited enzyme by only one reaction rate constant (from equation V).

In all experiments there is a large surplus of inhibitor molecules compared to protease molecules, i.e. a constant concentration of inhibitor (corresponding to the added amount of inhibitor) is a reasonable assumption.

The specific values of the reaction rate constants are somewhat sensitive to small variations in the data, but the sensitivity is reduced significantly by giving the results relatively to the value from Boric Acid. An improvement factor is thus derived:

$$IF_I = \frac{K_I(\text{Boric Acid})}{K_I(\text{Inhibitor})}$$

$IF_I$ measures the inhibition efficiency given by the inhibition constants $K_I$ from reaction III.

b) Determination of $K_i$: The inhibition constant $K_i$ may be determined by using standard methods, for reference see Keller et al, *Biochem. Biophys. Res. Com.* 176, 1991, pp.401–405; J. Bieth in *Bayer-Symposium "Proteinase Inhibitors"*, pp. 463–469, Springer-Verlag, 1974 and Lone Kierstein Hansen in "*Determination of Specific Activities of Selected Detergent Proteases using Protease*

*Activity, Molecular Weights, Kinetic Parameters and Inhibition Kinetics",* PhD-report, Novo Nordisk A/S and University of Copenhagen, 1991.

The invention is further illustrated in the following examples which are not intended to be in any way limiting to the scope of the invention as claimed.

EXAMPLE 1

Preparation of 4-Formyl-Phenyl-Boronic Acid

4-Formyl-phenyl-boronic acid may be prepared as disclosed in *Chem. Ber.* 123, 1990, pp. 1841–1843, or it may be bought at Lancaster Synthesis GmbH (4-Formylbenzeneboronic acid).

EXAMPLE 2

Determination of $K_i$

The inhibition constant $K_i$ for the inhibition of Savinase™ (available from Novo Nordisk A/S) was determined using standard methods under the following conditions:

Substrate: Succinyl-Alanine-Alanine-Proline-Phenylalanine-para-nitro-anilide=SAAPFpNA (Sigma S-7388).

Buffer: 0.1M Tris-HCl pH 8.6; 25° C.

Enzyme concentration in assay:

Savinase: $1\times10^{-10}$–$3\times10^{-10}$M

The initial rate of substrate hydrolysis was determined at nine substrate concentrations in the range of 0.01 to 2 mM using a Cobas Fara automated spectrophotometer. The kinetic parameters $V_{max}$ and $K_m$ were determined using ENZFITTER (a non-linear regression data analysis program).

$k_{cat}$ was calculated from the equation $V_{max}=k_{cat}$ X $[E_o]$. The concentration of active enzyme $[E_o]$ was determined by active site titration using tight-binding protein proteinase inhibitors. The inhibition constant $K_i$ was calculated from plots of $K_m/k_{cat}$ as a function of the concentration of inhibitor. The inhibitors were assumed to be 100% pure and the molar concentrations were determined using weighing numbers and molecular weights.

The results of the inhibition constants $K_i$ of the phenyl boronic acid derivative enzyme stabilizers tested are listed below:

| Inhibitor: | $K_i$ (Savinase): |
|---|---|
| Boric acid | 20 mM |
| 4-formyl-phenyl-boronic acid | 0.3 mM |

| Inhibitor: | $K_i$ (Savinase): |
|---|---|
| Boric acid | 20 mM |
| acetamidophenyl boronic acid | 1 mM |

EXAMPLE 3

Storage Stability Test in Liquid Detergent

Phenyl boronic acid derivatives were also tested in storage stability tests in liquid detergents using the method described previously under the following conditions:

Detergent base (US-type)

| | % wt (as pure components) |
|---|---|
| Nansa 1169/p (Linear Alkylbenzene Sulfonate, LAS) | 10.3 |
| Berol 452 (Alkyl Ether Sulfate, AES) | 3.5 |
| Oleic acid | 0.5 |
| Coconut fatty acid | 0.5 |
| Dobanol 25-7 (Alcohol Ethoxylate, AEO) | 6.4 |
| Sodium xylene sulfonate | 5.1 |
| Ethanol | 0.7 |
| MPG (Mono Propylene Glycol) | 2.7 |
| Glycerol | 0.5 |
| Sodium sulfate | 0.4 |
| Sodium carbonate | 2.7 |
| Sodium citrate | 4.4 |
| Citric acid | 1.5 |
| Water | 60.8 |
| Enzyme dosage: | 1% w/w Savinase (14 KNPU/g) |
| Enzyme Stabilizer Dosage: (for boric acid 160 mmole/kg) | 5 mmole/kg |
| Storage: | 0, 3, 7 and 14 days at 30° C. |

The results of the inhibition effectiveness $IF_I$ of the phenyl boronic acid enzyme stabilizers tested are listed below:

| Inhibitor: | Improvement Factor ($IF_I$) |
|---|---|
| Boric acid | 1 |
| 4-formyl-phenyl-boronic acid | 1000 |

For comparison reasons acetamidophenyl boronic acid, 2-formyl-phenyl-boronic acid and 3-formyl-phenyl-boronic acid (all bought at Lancaster) were tested in the same system giving the following results:

| Inhibitor: | Improvement Factor ($IF_I$) |
|---|---|
| Boric acid | 1 |
| acetamidophenyl boronic acid | 300 |
| 2-formyl-phenyl-boronic acid | 36 |
| 3-formyl-phenyl-boronic acid | 230 |

It appears from the results given above that the storage stability properties of 4-formyl-phenyl boronic acid is at least three times better than those of acetamidophenyl boronic acid, and at least four times better than those of 3-formyl-phenyl-boronic acid, and at least 25 times better than those of 2-formyl-phenyl-boronic acid (all calculated on molar basis).

EXAMPLE 4

Storage Stability Test in a Commercial Detergent

The inhibition effectiveness $IF_I$ of 4-formyl-phenyl-boronic acid was also found in a commercial detergent Omo Micro.

Omo Micro was bought in a Danish supermarket. The enzymes were inactivated at 90° C. (overnight).

The following dosages in the detergent were used:

4-Formyl-phenyl-boronic acid: 1.33 mM, or

Boric acid: 160 mM, and

Protease: 1% w/w Savinase (8 KNPU/g), and

Lipase: 1% w/w Lipolase (100 KLU/g).

Storage: 0, 7, 15, and 21 days at 40° C.

Result: $IF_I$=2500.

EXAMPLE 5

Storage Stability Test of 4-Carboxybenzeneboronic Acid in Liquid Detergent

4-Carboxybenzeneboronic acid (bought at Lancaster) was tested in a storage stability test in a liquid detergent using the method described previously under the following conditions:

Detergent base (US-type)

| | % wt (as pure components) |
|---|---|
| Nansa 1169/p (Linear Alkylbenzene Sulfonate,LAS) | 10.3 |
| Berol 452 (Alkyl Bther Sulfate, AES) | 3.5 |
| Oleic acid | 0.5 |
| Coconut fatty acid | 0.5 |
| Dobanol 25-7 (Alcohol Ethoxylate, AEO) | 6.4 |
| Sodium xylene sulfonate | 5.1 |
| Ethanol | 0.7 |
| MPG (Mono Propylene Glycol) | 2.7 |
| Glycerol | 0.5 |
| Sodium sulfate | 0.4 |
| Sodium carbonate | 2.7 |
| Sodium citrate | 4.4 |
| Citric acid | 1.5 |
| Water | 60.8 |
| Enzyme dosage: | 1% w/w Savinase (14 KNPU/g) |
| Enzyme Stabilizer Dosage: (for boric acid 160 mmole/kg) | 5 mmole/kg |
| Storage: | 0, 2, 7 and 14 days at 30° C. |

Result: $IF_I$ = 22.

We claim:

1. A liquid composition comprising a protease and a phenyl boronic acid derivative enzyme stabilizer of the following formula:

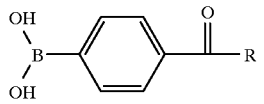

wherein R is selected from the group consisting of hydrogen, hydroxy, $C_1$–$C_6$ alkyl substituted $C_1$–$C_6$ alkyl, $C_1$–$C_6$ alkenyl and substituted $C_1$–$C_6$, alkenyl.

2. A liquid composition of claim 1, wherein R is $C_1$–$C_6$ alkyl.

3. A liquid composition of claim 1, wherein R is hydrogen.

4. A liquid composition of claim 1, additionally comprising a second enzyme selected from the group consisting of an amylase, a lipase, a cellulase, an oxidoreductase, and mixtures thereof.

5. A liquid composition of claim 4, wherein the second enzyme is a lipase.

6. A liquid composition of claim 1, wherein said phenyl boronic acid derivative enzyme stabilizer is the alkali metal salt of the boronic acid.

7. A liquid composition of claim 1, wherein said phenyl boronic acid derivative enzyme stabilizer is added in an amount of up to 500 mM.

8. A liquid detergent composition comprising a surfactant, a protease and a phenyl boronic acid derivative enzyme stabilizer of the following formula:

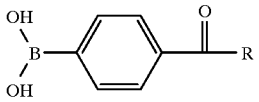

wherein R is selected from the group consisting of hydrogen, hydroxy, $C_1$–$C_6$ alkyl, substituted $C_1$–$C_6$ alkyl, $C_1$–$C_6$ alkenyl and substituted $C_1$–$C_6$ alkenyl.

9. A liquid detergent composition of claim 8, wherein R is $C_1$–$C_6$ alkyl.

10. A liquid detergent composition of claim 8, wherein R is hydrogen.

11. A liquid detergent composition of claim 8, additionally comprising a second detergent-compatible enzyme selected from the group consisting of an amylase, a lipase, a cellulase, an oxidoreductase, and mixtures thereof.

12. A liquid detergent composition of claim 11, wherein the second enzyme is a lipase.

13. A liquid detergent composition of claim 8, wherein said phenyl boronic acid derivative enzyme stabilizer is the alkali metal salt of the boronic acid.

14. A liquid detergent composition of claim 8, wherein said phenyl boronic acid derivative enzyme stabilizer is added in an amount of up to 500 mM.

15. The liquid composition of claim 7, wherein said phenyl boronic acid derivative enzyme stabilizer is added in an amount of 0.001–250 mM.

16. The liquid composition of claim 15, wherein said phenyl boronic acid derivative enzyme stabilizer is added in an amount of 0.005–100 mM.

17. The liquid composition of claim 16, wherein said phenyl boronic acid derivative enzyme stabilizer is added in an amount of 0.01–10 mM.

18. The liquid composition of claim 14, wherein said phenyl boronic acid derivative enzyme stabilizer is added in an amount of 0.001–250 mM.

19. The liquid composition of claim 18, wherein said phenyl boronic acid derivative enzyme stabilizer is added in an amount of 0.005–100 mM.

20. The liquid composition of claim 19, wherein said phenyl boronic acid derivative enzyme stabilizer is added in an amount of 0.01–10 mM.

* * * * *